United States Patent [19]

Buck et al.

[11] Patent Number: 5,042,105

[45] Date of Patent: Aug. 27, 1991

[54] MOP HEAD COVER

[76] Inventors: Melissa J. Buck; Barbara J. Buck, both of 5943 Briarmist Pl., St. Louis, Mo. 63128

[21] Appl. No.: 578,596

[22] Filed: Sep. 4, 1990

[51] Int. Cl.[5] ..... A47L 13/20; A47L 13/44

[52] U.S. Cl. ..... 15/247; 15/228; 15/209 R; 15/231

[58] Field of Search ..... 15/247, 228, 147 B, 15/244.3, 210 R, 209 R

[56] References Cited

U.S. PATENT DOCUMENTS

| | | | |
|---|---|---|---|
| 745,112 | 11/1903 | Margerison | 15/209 R |
| 1,138,305 | 5/1915 | Miller | 15/247 |
| 2,141,336 | 12/1938 | Bailey | 15/247 |
| 2,288,592 | 7/1942 | Mirhige | 15/247 |
| 2,717,437 | 9/1955 | Mestral | 15/209 R |
| 2,815,521 | 12/1957 | Winckler | 15/247 |
| 4,845,800 | 7/1989 | Pederson | 15/228 |
| 4,945,599 | 8/1990 | Flynn | 15/247 |

*Primary Examiner*—Philip R. Coe
*Assistant Examiner*—Terrence R. Till
*Attorney, Agent, or Firm*—Robbins & Robbins

[57] ABSTRACT

A terry cloth cover for a clamp on sponge mop is provided. The cover is tubular and closed at one end with the other end being open and provided with Velcro patches in order that it may be fitted over the sponge and closed. Holes are provided to fit over the conventional studs that are used in the sponge for fitting on the mop clamp on base. The loops or pile on the terry cloth enable the mop to reach depressions in embossed floor tile surfaces for enhanced cleaning.

10 Claims, 1 Drawing Sheet

MOP HEAD COVER

BACKGROUND OF THE INVENTION

In the past various types of sponge mops have been employed. Such mops conventionally employ a replaceable sponge element which can be screwed or clamped on a sponge element holder or base attached to the usual mop handle. The sponge elements can be of various types that can be removed as they wear out and replaced with new sponge elements.

Such sponge mops are used to clean various types of flooring surfaces such as wood, vinyl, tile and the like. While generally effective for their purpose a problem has existed in cleaning the depressions in embossed tile where the wet sponge can not reach and perform an effective cleaning action.

SUMMARY OF THE INVENTION

By means of this invention there has been provided an easily replaceable cover for a sponge mop. The cover has an exterior rough surface which can effectively reach into grooves or depressions commonly found in embossed vinyl floor, tile and other types of physically embossed or patterned floor surfaces while still performing an efficient cleaning action on the raised portions of the floor surfaces.

The cover is made in the form of a tube or bat which can be loosely fitted over the sponge when removed from the mop. The open end may be closed when so fitted by the use of Velcro patches or the like. The cover is conveniently made of terry cloth which in the relatively rough or irregular piling presented by the loops of the terry cloth provides a roughened and yielding surface for cleaning various types of flooring surfaces. The cover is particularly efficient in the cleaning of floor tiling having embossed surfaces where the depressions are difficult to reach by conventional sponge mops.

The mop head cover can be simply made from conventional tube socks which are closed at one end and open at the other end. The tube sock is simply cut to the proper length at the open end and provided with Velcro patches to close the cover when fitted over the removable sponge. Appropriate openings, or apertures, are cut to register with connecting studs that may be employed to connect the sponge to the mop.

The cover may be made to fit various types of sponge mops to provide a mop cover which may be used for conventional cleaning as well as hard to reach surfaces. The cover is rugged, easy to install by unskilled user and efficient in cleaning power.

The above features are objects of this invention. Further objects will appear in the detailed description which follows and will be otherwise apparent to those skilled in the art.

For purpose of illustration of this invention a preferred embodiment is shown and described hereinbelow in the accompanying drawing. It is to be understood that this is for the purpose of example only and that the invention is not limited thereto.

IN THE DRAWING

DESCRIPTION OF THE INVENTION

Figure 1:
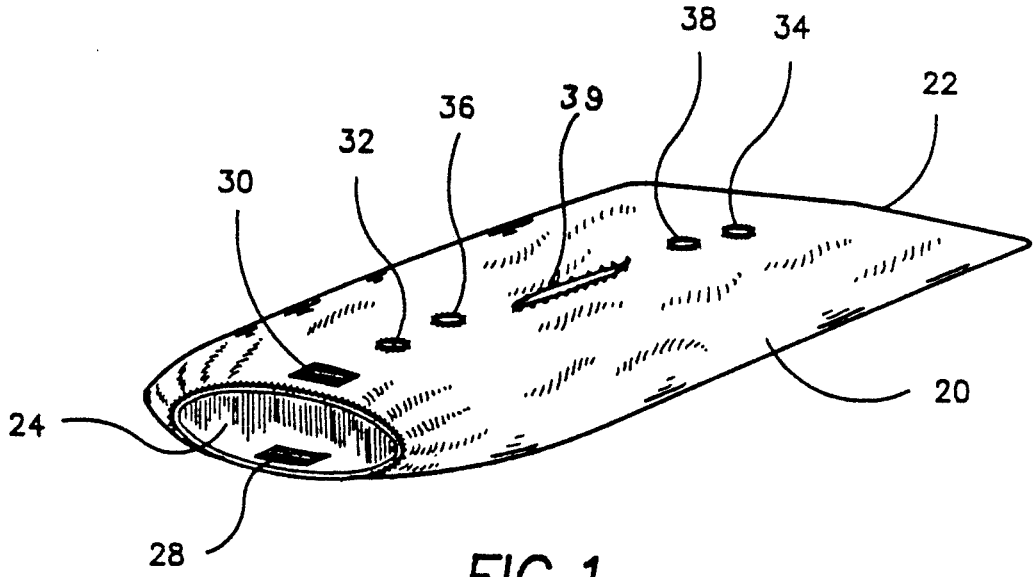
FIG. 1 is a pictorial view of a sponge mop provided with the mop head cover.
Figure 2:
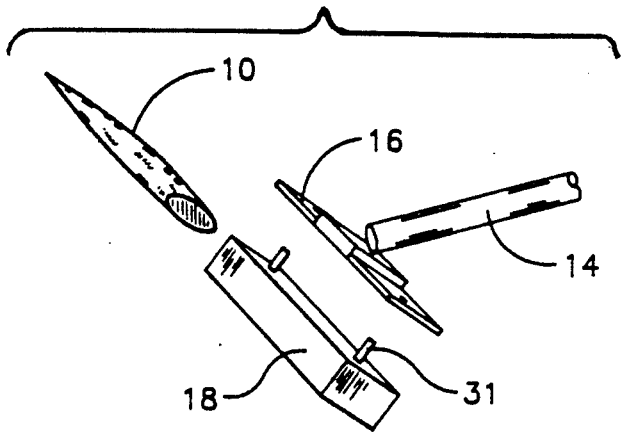
FIG. 2 is a pictorial view of the mop head cover.
Figure 3:
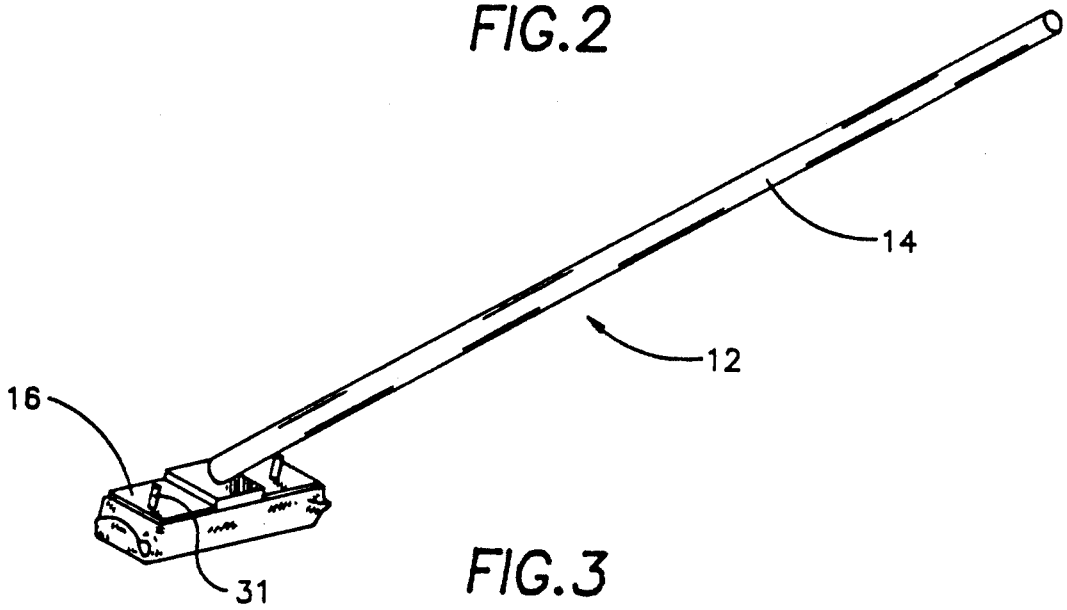
FIG. 3 is a perspective view of the mop head cover and mop when in use.

The mop head cover of this invention is generally indicated by the reference numeral 10 in FIG. 1. It is shown for use with a sponge mop 12, having a handle 14, a base or head 16 and a replaceable sponge 18. The sponge is replaceable, as desired, by fresh sponges.

The mop head cover 10 is in the form of a bag-like tube 20 having a closed end 22 and an open end 24 in order that it may be loosely fitted over the sponge 18. When the sponge 18 is removed and fitted with the cover 10 the two may then be refitted upon the base head 16 by clamping or the like. Such clamping structures for the sponge mop are conventional and form no part of this invention, per se.

The cover 10 is most desirably constructed of a rough towel-like fabric such as terry cloth. The deep closed loop soft piling of the terry cloth has been found to be most efficient in reaching shallow depressions such as in embossed floor tile or the like. Conveniently such a surface may be provided by turning a conventional cotton or synthetic fiber tube sock inside out. Such a surface has been found to be more effective in reaching embossed patterns in flooring and removing dirt than a sponge with a textured surface, a net covering for the sponge or a waffle weave cotton covering for the sponge. The loops on the terry cloth reach into the pattern embossed on the floor, to get out more accumulated dirt, and the terry cloth combined with the sponge holds more water than the sponge would alone. Thus, there is more water on the floor to loosen and float out the dirt. The mop head cover is designed particularly for no-wax vinyl floors with embossed patterns, but may be used on any type of floor.

In order to provide a closure for the open end 24 of the cover, an elastic band 26 is provided. This is sewn along the circumferential edge of the open end. In addition, Velcro patches 28 and 30 are employed to tightly close the open end. The Velcro patches provide sufficient holding power when engaged together to resist accidental separation but can be easily pulled apart when desired to be disengaged. The patches are used in mating relation with one patch comprising a large number of closely spaced hooking elements of flexible resilient plastic and the mating patch having a greater number of flexible loops of a resilient material. They are described in U.S. Pat. Nos. 2,717,427; 4,000,384 and 3,009,235 and form no part of this invention, per se.

In order to fit over sponges that may use a backing with provision for stud elements 31, such as friction studs, bolts or the like, openings, or apertures 32 and 34 are provided in the cover. These openings are designed to register with the stud elements on various types of sponge mops. A second pair of openings or apertures 36 and 38 may also be provided in order to fit stud openings in a different model of sponge mop that may be frequently encountered. In addition a slot 39 is provided for a type of mop that uses a metal hook on the handle which slides into a slot on the mop head (not shown) which necessitates a slit in the mop head to accommodate this type of attachment.

While the mop head cover may be constructed from terry cloth flat goods it has been found that it may be conveniently constructed from commonly found tube socks which have a smooth exterior and a terry cloth interior. Such socks generally have a degree of flexibility and elasticity such that when selected for the proper size they may be simply turned inside out and employed as the mop head cover.

In the construction of the cover 10 from a tube sock, the open end of the sock is cut off to provide a proper length of the sock. The cut off end of the sock is then stitched with a zig-zag stitch 40 to prevent raveling. The elastic band 26 and the Velcro patches 28 and 30 are then affixed to the open end. The sponge stud openings 32 and 34 and 36 and 38 are then cut into registering openings. Zig-zag stitching 42 is applied to the edges of the opening to prevent raveling of the cut edges.

USE

The mop head cover is simply employed with the sponge mop 12. It may be added or removed at will enabling the mop to be used with the mop head cover or without the cover as desired. Thus the sponge mop may be used as a general purpose mop, wet or dry, or with the cover to cleanse shallow depressions in embossed flooring and other types of surfaces.

The sponge mop is employed when the sponge is desired to be replaced or the cover 10 added in a conventional manner by simply unclamping the sponge element 18 from the base or head 16. The mop head cover 10 is then fitted over the sponge element by spreading the open end and pulling the cover over the sponge. The stud element openings are registered with stud elements on the sponge or the mop base to provide proper alignment.

After the interfitting the open end which may be partially closed through the action of the elastic band 26 is firmly closed by pressing the opposite sides of the open end together to connect the mating Velcro patches 28 and 30 together. The sponge and cover are then reclamped as a unit to the base or head 16 for use as desired.

Various changes and modifications may be made within this invention as will be apparent to those skilled in the art. Such changes and modifications are within the scope and teaching of this invention as defined in the claims appended hereto.

What we claim is:

1. In a sponge mop comprising in combination a handle, a base disposed at one end of said handle, a sponge element removably mounted to said base by means of stud elements, the improvement comprising a mop head cover, said mop head cover consisting of a terry cloth fabric exterior adapted to cleanse embossed surfaces to be cleaned, said mop head cover being tubular with a closed end and an open end and a sized to be removably fitted over said sponge element and means for closing said open end, said mop head cover being provided with apertures registering with said stud elements to facilitate fitting of the cover over said sponge element.

2. The mop of claim 1 in which said means for closing said open end comprises mating patches having hook and loop fastening means on opposite sides of the open end adapted to be connected together to close said open end.

3. The mop of claim 1 in which said means for closing said open end comprises an elastic band on said cover adjacent a circumferential edge of said open end.

4. The mop of claim 1 in which said apertures are in the form of separate pairs of apertures and an elongated slit for fitting over elements on separate sponge attachment elements having different attachment element spacing.

5. The mop of claim 1 in which stitching is provided around a circumferential edge of the open end to prevent raveling.

6. The mop head cover of claim 1 in which said mop head cover is made by turning a tube sock inside out to expose a terry cloth interior as an exterior surface, cutting a selected length off said sock at an open end thereof and adding means for closing said remaining open end of the sock.

7. The mop head cover of claim 6 in which patches having hook and loop fastening means are added to opposite sides of the open end of the sock.

8. The mop of claim 6 in which an elastic band is added to a circumferential edge of said open end of the sock.

9. The mop head cover of claim 6 in which patches having hook and loop fastening means are added to opposite sides of the open end of the sock and an elastic band is added to a circumferential edge of said open end of the sock.

10. The mop of claim 6 in which said open end is stitched circumferentially to prevent raveling.

* * * * *